US007647973B2

(12) United States Patent
Minassian et al.

(10) Patent No.: US 7,647,973 B2
(45) Date of Patent: Jan. 19, 2010

(54) COLLAPSE ARRESTOR TOOL

(75) Inventors: Marc Minassian, LaPorte, TX (US); Robert K. Voss, Houston, TX (US); Kevin G. Buckle, Tipperty By Ellon (GB); Steven P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 429 days.

(21) Appl. No.: 11/488,747

(22) Filed: Jul. 18, 2006

(65) Prior Publication Data

US 2008/0017383 A1 Jan. 24, 2008

(51) Int. Cl.
*E21B 41/04* (2006.01)

(52) U.S. Cl. ..... 166/338; 166/336; 166/339; 166/368; 166/250.17; 166/250.08

(58) Field of Classification Search ..... 166/338, 166/336, 339, 368, 250.08, 337, 250.17, 166/88.1, 89.1, 138
See application file for complete search history.

(56) References Cited

U.S. PATENT DOCUMENTS 4,559,809 A * 12/1985 Mayo ..... 73/40.5 R
6,390,194 B1 * 5/2002 Young et al. ..... 166/250.08
6,962,206 B2 * 11/2005 Hirth et al. ..... 166/387
6,966,381 B2 * 11/2005 Stjernstrom et al. ..... 166/337
2003/0000693 A1 * 1/2003 Couren et al. ..... 166/66
2004/0200614 A1 * 10/2004 Stjernstrom et al. .... 166/250.08
2005/0082066 A1 * 4/2005 McGuire et al. ..... 166/379
2007/0215348 A1 * 9/2007 Corre et al. ..... 166/264

* cited by examiner

*Primary Examiner*—Thomas A Beach
*Assistant Examiner*—Matthew R Buck
(74) *Attorney, Agent, or Firm*—Bracewell & Giuliani

(57) ABSTRACT

A tool is employed with a subsea wellhead assembly for preventing the collapse of a wear bushing located in a drill-through tubular member due to external test forces being applied to it. The tool has a connector that connects to the drill-through tubular member. A stem extends downward from the connector and has a reacting member at its lower end. The reacting member engages an inner diameter of the wear bushing to resist inwardly directed forces due to fluid pressure on the exterior of the wear bushing. The tool can be incorporated with a running tool or with a blowout preventer isolation test tool.

21 Claims, 6 Drawing Sheets

COLLAPSE ARRESTOR TOOL

BACKGROUND OF THE INVENTION

A subsea well is typically drilled by drilling a first portion of the well and installing conductor pipe and an outer wellhead housing. Then the well is drilled to a second depth and a first string of casing is installed, the casing being suspended by a high pressure wellhead housing that lands in the low pressure wellhead housing. In one technique, the operator lowers a blowout preventer on a riser and attaches the blowout preventer to the high pressure wellhead housing, then drills the well to total depth.

If the operator is using one type of production tree, referred to herein as a "vertical" tree, he will then complete the well by perforating and installing tubing, with the tubing hanger landing in the high pressure wellhead housing. He then will install a production tree on top of the high pressure wellhead housing.

Alternatively, the operator could land a tubing head or spool on the high pressure wellhead housing before the well is drilled to total depth and connect the blowout preventer to the tubing spool. The operator would complete the drilling through the tubing spool and complete the well by installing the tubing hanger in the tubing spool. The vertical tree would then be landed on the tubing spool.

If the operator is going to use another type of tree, called a "horizontal" or "spool" tree, typically, he would install the tree on the high pressure wellhead housing, then complete the well and land the tubing hanger within the tree.

Another technique involves landing a horizontal tree on the high pressure wellhead housing before employing the drilling riser and blowout preventer to drill the well to total depth. In this technique, the first and second portions of the well are drilled and at least the first string of casing installed without the use of a blowout preventer. The horizontal tree lands on top of the high pressure wellhead housing, and the drilling riser is connected to the upper end of the horizontal tree. The drilling riser may have a subsea blowout preventer, or it may be of a high pressure type with a surface blowout preventer located on the drilling vessel. The operator drills through the tree to total depth and runs the casing through the blowout preventer and drilling riser. The operator installs the tubing hanger in the horizontal tree.

Both a tubing spool and a horizontal tree have one or more ports that lead from the bore to the exterior. These ports may include tubing annulus ports that communicate with the annulus surrounding the string of tubing. Also, ports exist for supplying hydraulic fluid pressure to mating ports in the tubing hanger for a downhole safety valve. There may be ports for electrical lines for downhole sensors, as well. A horizontal tree also has a production outlet port leading from the bore, but a tubing spool would not have a production outlet port.

A wear bushing will be fitted within the bore of a horizontal tree or tubing spool while at the surface to protect the sealing surfaces within the bore during subsequent drilling. The wear bushing is a tubular sleeve that will cover all of the ports leading into the bore and all sealing surfaces in the bore. Normally the wear bushing is sealed to the tree bore above and below the ports to prevent entry of drilling mud and debris into the ports.

Industry practice requires that the valves leading to these various ports be tested after the tree or tubing spool has been installed on the high pressure wellhead housing. Normally, each port will have a small diameter test passage that leads to it for supplying hydraulic fluid pressure to the port between the valve and the wear bushing. The test pressure exerts an inward force on the wear bushing.

With a drill-through tubular member, such as a horizontal tree or tubing spool, the wear bushing is quite thin so as to maintain a full bore diameter for the passage of casing, casing hangers, drill bits and the like. The test pressure could cause buckling and collapsing of the wear bushing. U.S. Pat. No. 6,966,381 discloses placing a test sleeve within the wear bushing to prevent collapse of the wear bushing during pressure testing of the port valves, then retrieving the test sleeve before commencing drilling.

Another test procedure required is to test the blowout preventer after it has landed and before drilling occurs. A blowout preventer has a number of closure members that will close around conduit and also close the full bore. Also, choke and kill lines extend alongside the riser from the surface to a point below one or more of the closure members of the blowout preventer. One manner of testing the blowout preventer is to lower a test tool on a string of drill pipe through the blowout preventer. The test tool has a packer element that seals to the bore of the tubular member on which the blowout preventer is secured. The operator closes one of the closure members around the drill pipe and supplies fluid pressure through one of the choke and kill lines to the sealed chamber defined by the closure member and the packer element. If the test is successful, the test tool is retrieved and the drill string ran back in with a drill bit.

SUMMARY OF THE INVENTION

In this invention, a tool is lowered into the tree or tubing spool. The tool has an upper supporting member on its end, a stem extending downward from the supporting member and a reacting member on the stem. The reacting member locates within and engages an inner diameter of the wear bushing. Then, test pressure is applied to the port, which acts externally against the wear bushing but is resisted by the reacting member.

In one embodiment, the tool serves as a running tool for the tree. In other embodiments, the tool serves also as a blowout preventer testing tool. In that instance, the upper supporting member of the tool has a seal that seals to the bore of the tree or tubing spool. The tool is located on a string of drill pipe, and the blowout preventer is closed around the drill pipe, resulting in a chamber between the supporting member of the tool and the blowout preventer. The operator applies fluid pressure to this chamber to test the blowout preventer. The valve ports in the tree or tubing spool would be tested during the same trip.

The reacting member may be of various types, whether incorporated with a blowout preventer test tool or tree running tool. The reacting member may be a rigid member with an outer diameter substantially the same as the inner diameter of the wear bushing. For example, the reacting member could comprise a number of vertical plates extending radially from the stem.

In another embodiment, the reacting member seals to the inner diameter of the wear bushing. The supporting member seals to the bore of the tree, defining a sealed chamber between the supporting member and the reacting member. The operator applies fluid pressure to the chamber to exert an outward force on the wear bushing to resist the inward force being exerted by the test pressure. In a further embodiment, the reacting member comprises an inflatable bladder that is expanded radially by pumping fluid pressure through the stem.

When incorporated with a blowout preventer test tool, the tool may be re-run to again test the valves after the drilling is completed and before running the tubing hanger. The tool may have a gripping member to grip the wear bushing. In that instance, retrieving the tool also retrieves the wear bushing.

DETAILED DESCRIPTION OF THE INVENTION

Figure 1:
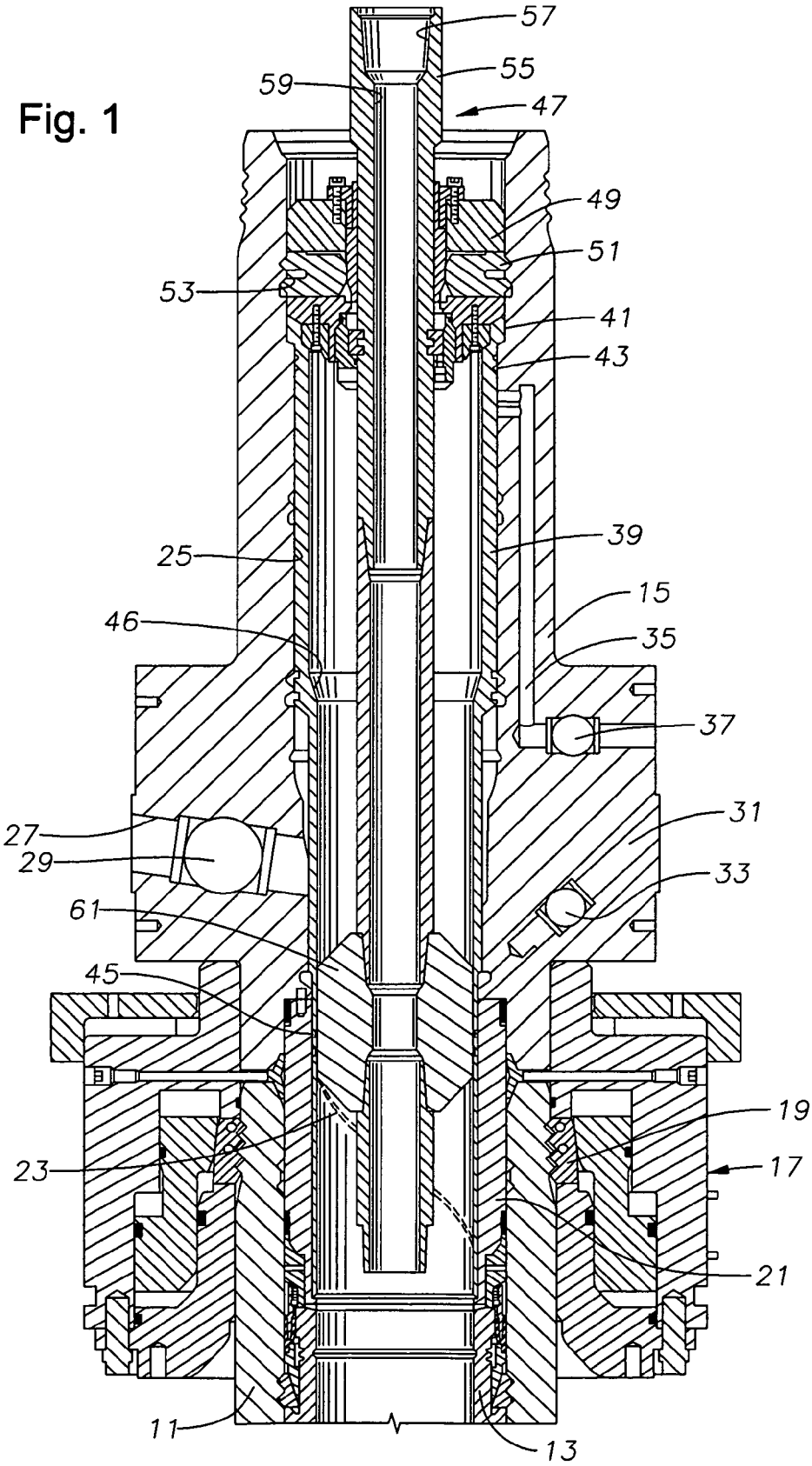
FIG. 1 is a sectional view illustrating a first embodiment tool in accordance with this invention, the tool being a running tool for the tree as well as resisting test pressure forces applied externally to the wear bushing.

Referring to FIG. 1, a portion of a subsea wellhead assembly is shown, including a high pressure wellhead housing 11. High pressure wellhead housing 11 lands within a low pressure wellhead housing (not shown) and has a string of casing that extends into the well to a selected depth. In this example, a casing hanger 13 is shown, which would be connected to another string of casing that would extend to a deeper point in the well. In this example, the well was drilled and casing hanger 13, along with its string of casing (not shown), cemented in the well all without the use of a drilling riser. However, in some cases, no casing would be installed within high pressure wellhead housing 11 until the drilling riser is employed.

To continue drilling, the operator will install a drill-through tubing member on wellhead housing 11, and connect a drilling riser to the tubular member. In this embodiment, the drill-through tubular member comprises a horizontal tree 15, but it could comprise tubing spool instead. Tree 15 has a wellhead connector 17 on its lower end that is conventional and has dogs 19 that are actuated into engagement with an external profile on wellhead housing 11. In this example, tree 15 has an orientation sleeve 21 that extends downward from it for sliding into the bore of wellhead housing 11 above casing hanger 13. Orientation sleeve 21 has a helical groove 23 that is subsequently engaged by a key (not shown) of a tubing hanger assembly (not shown) to orient the tubing hanger relative to tree 15.

Tree 15 has an axial bore 25 that extends through it. In this example, the inner diameter of bore 25 is greater at the upper end and smaller at the lower end of tree 15, but the smallest inner diameter portion is essentially the same as the inner diameter of casing hanger 13. A production outlet 27 extends from the exterior of tree 15 to bore 25. A production valve 29 controls well fluid flowing out production passage 27. A lower tubing annulus 31 extends from bore 25 to the exterior of tree 15. Lower tubing annulus 31 communicates an annular space surrounding the tubing (not shown) with the exterior and has a valve 33. In this example, an upper tubing annulus passage 35 extends between bore 25 near the upper end of bore 25 to the exterior. A valve 37 within upper tubing annulus passage 35 controls fluid flow to upper tubing annulus passage 35. In addition, although not shown, ports will exist for supplying hydraulic fluid pressure to ports in the tubing hanger for delivery through lines to a downhole safety valve. Also, tree 15 may have one or more ports for electrical lines leading from the exterior to bore 25 for connection with temperature and pressure sensors and optionally an electrical submersible pump.

In some applications, a tubing spool would be employed rather than horizontal tree 15. A tubing spool would resemble tree 15 but it would not have a production passage 27. As a tubing spool, it would have a shoulder for landing a tubing hanger within, and it would have ports for hydraulic fluid and optionally electrical lines.

Prior to lowering tree 15 into the sea, a wear bushing 39 is installed within bore 25. Wear bushing 39 is a sleeve that provides protection to bore 25 against damage during drilling operations. Wear bushing 39 covers all of the ports or passages mentioned, including production outlet passage 27, and tubing annulus passages 31 and 35. Preferably wear bushing 39 has an upper shoulder 41 that lands on a mating shoulder in bore 25. Also, wear bushing 39 preferably has an upper seal 43 located above the point where upper tubing annulus passage 35 enters bore 25. A lower seal 45 locates below the point where lower tubing annulus 31 intersects bore 25. In this example, lower seal 45 is located in the inner diameter of orientation sleeve 21, which may be considered to be part of tree 15. Wear bushing 39 extends to the lower end of orientation sleeve 21 and covers helical groove 23, preferably.

Both the inner and outer diameters of wear bushing 39 may vary, as shown. The upper portion of the inner diameter is greater than the lower portion in this example, defining an upward facing tapered shoulder 46. The inner diameter of the lower portion of wear bushing 39 is equal or greater than the minimum inner diameter of any tubular structure located below, such as the inner diameter of the casing attached to casing hanger 13. The outer diameter of the upper portion of wear bushing 39 is also greater than the outer diameter of the lower portion, and the thickness of the upper portion is greater.

After landing tree 15, test fluid pressure can be applied to each port or passage 27, 31, 35 and those mentioned but not shown. This pressure exerts a radial inward force on wear bushing 39, tending to cause it to collapse.

In the embodiment of FIG. 1, a tool 47 has features to arrest collapsing that might otherwise occur. In this embodiment, tool 47 has a connector 49 that connects tool 47 to tree bore 25 for running tree 15. Connector 49 may be conventional and has a locking element 51 that is urged outward into engagement with a grooved profile 53 formed in bore 25. A stem or mandrel 55 extends through connector 49. In this example, stem 55 and connector 49 have mating threads so that rotating stem 55 in one direction pushes locking element 51 outward and rotating in the opposite direction allows locking element 51 to collapse inward. Alternatively, this connection may be activated by hydraulic pressure supplied via a remote operated vehicle or by an umbilical line to the surface. Stem 55 has an upper threaded end 57 that connects to a drill string for rotating stem 55. Stem 55 has an axial passage 59 extending through it in this example.

A reaction member 61 is secured to stem 55 for engaging the inner diameter of at least a portion of wear bushing 39. Reacting member 61 is shown engaging a lower and thinner portion of wear bushing 39, but the position could differ. Reacting member 61 may have a variety of configurations and is rigid in the example of FIG. 1. Preferably, it comprises a plurality of radially extending plates or blades, but it could also be solid because there is no requirement for fluid to pass through the annulus surrounding stem 55 in this example.

In the method of FIG. 1, tool 47 is connected to tree 15 at the surface with its connector 49. The operator lowers tree 15 from the surface onto wellhead housing 11, typically by connecting a string of drill pipe to tool 47. The operator actuates wellhead connector 17 in a conventional manner. The operator makes up various connections to the ports and passages of tree 15 and supplies test fluid pressure to the various ports to test the various valves 29, 33 and 37. The operator tests the valves in a conventional manner. The test fluid pressure communicates and is applied to the outer diameter of wear bushing 39 between upper and lower seals 43, 45. Valves 29, 33 and 37 and valves for any other ports will be closed at this time, enabling the operator to determine whether pressure holds. The radial inward force due to the test pressure is resisted by the rigid reacting member 61. Because of the larger outer diameter of the upper portion of wear bushing 39, there will be an upward force component due to the external test pressure. The engagement of locking element 51 with the profile in bore 25 resists the upward force.

After testing, the operator rotates stem 55 in the opposite direction to allow locking element 51 to retract, or unlocks the interface hydraulically if tool 47 is hydraulically actuated. The operator pulls tool 47 from wear bushing 39 to the surface. The operator then connects a driller riser to tree 15 and commences further drilling of the well.

Figure 2:
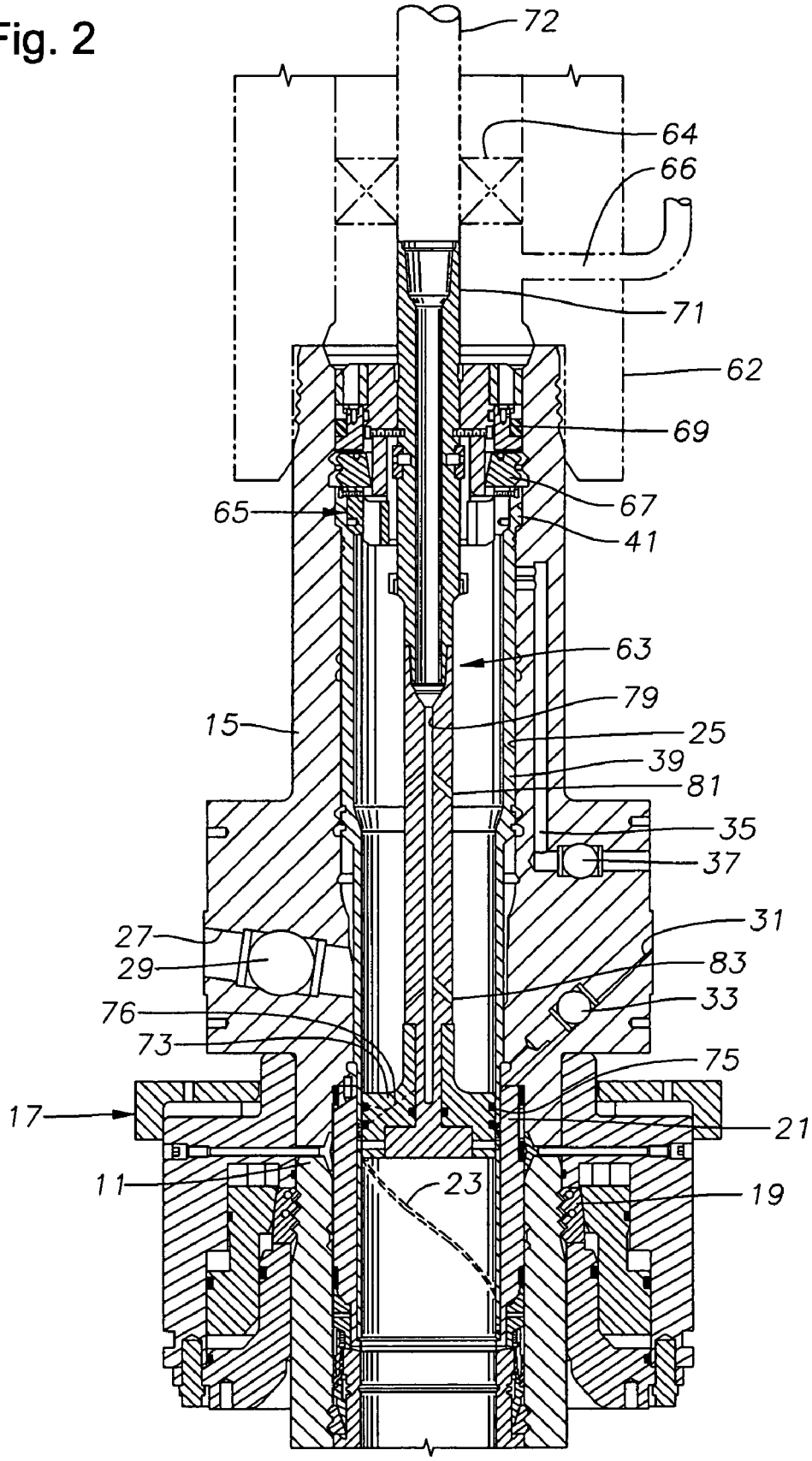
FIG. 2 is a partial sectional view illustrating a second embodiment of a tool in accordance with this invention, the tool being a blowout preventer test tool as well as resisting test pressure forces applied externally to the wear bushing.

In the embodiment of FIG. 2, the same numerals are utilized for tree 15. A BOP 62 ("BOP") is shown schematically connected to a grooved profile on the upper end of tree 15. BOP 62 is a conventional unit located at the lower end of and forming a part of a drilling riser. BOP 62 has a number of elements 64 for closing off fluid flow. Some of the elements 64 are sized for closing around pipe of various diameters, and others are sized for closing across the full bore or any diameter of pipe. BOP 62 also has a number of choke and kill lines 66 that extend alongside the riser and enter the interior of BOP 62 at different points between BOP elements 64 and between the lowest BOP element 64 and tree 15.

In the example of FIG. 2, tool 63 differs from tool 47 of FIG. 1 in that it is not used to run tree 15. Rather, tool 63 is lowered through the drilling riser and BOP 62 for testing the BOP and the valves of tree 15. Tool 63 has a supporting member 65 with a locking element 67, normally a split ring that selectively moves radially from a retracted position outward into engagement with profile in bore 25. Supporting member 65 lands on rim 41 of wear bushing 39 in this example. Tool 63 has a bore seal 69 that is typically elastomeric and seals against tree bore 25 when energized. A stem 71 extends through connector 65 and has an upper end that connects to a string of conduit, such as drill pipe 72. A J-slot and pin (not shown) in supporting member 65 retains tool 63 in a running-in position with locking element 67 retracted and seal 69 unenergized. Rotating stem 71 in one direction disengages the J-slot and pin, allowing stem 71 to move downward relative to supporting member 65. The downward movement causes locking element 67 to move outward into engagement with the profile in bore 25 and also pushes downward on seal 69 to deform it into sealing engagement with bore 25.

A reacting member 73 is mounted to a lower portion of stem 55 for engagement with the inner diameter of wear bushing 39. In this embodiment, reacting member 73 is annular and has seals 75 on its exterior for sealing against the inner diameter of wear bushing 39. Optionally, seals 75 could be initially retracted or recessed within the outer diameter of reacting member 73. Ports 76 lead to the bases of the grooves containing seals 75 for supplying fluid pressure to push seals 75 outward into sealing engagement with wear bushing 39 at the appropriate time.

The annular space surrounding stem 71 between upper seal 69 and reacting member seal 75 comprises a sealed chamber 77. Supporting member 65 and seal 69 serve as an upper packer, and reacting member 73 and seal 75 serves as a lower packer. Stem 71 has an axial passage 79 extending downward. Passage 79 is closed at the lower end, and has one or more outlets 81 that lead from passage 79 to chamber 77. Preferably, each outlet 81 has a pressure relief valve 83 that allows flow from stem passage 79 to chamber 77 only when a selected pressure has been achieved. Seal energizing ports 76 communicate directly with stem passage 79.

In the operation of the embodiment of FIG. 2, tree 15 is run and installed conventionally with a conventional running tool. Then the running tool is retrieved and the riser and BOP 62 attached. The operator then lowers tool 63 through the riser, BOP 62 and lands support member 65 on upper shoulder 41. The operator rotates drill pipe 72 to release stem 71 to move downward, which causes locking member 67 to engage the profile in tree bore 25.

The operator uses tool 63 to both test BOP 62 as well as prevent collapsing of wear bushing 39 during testing of tree valves 29, 33 and 37. BOP 62 is tested conventionally by closing element 64 around drill pipe 72 and pumping fluid through one of the choke and kill lines 66 into the chamber defined between test tool seal 69 and blowout preventer element 64. The operator may perform the blowout preventer test before or after testing valves 29, 33 and 37.

The dimensions of supporting member 65 may be selected to transfer the downward force on seal 69 during testing of BOP 62 through locking element 67 to tree 15 rather than to wear bushing rim 41 or vice-versa. Furthermore, if wear bushing 39 has sufficient strength to resist the downward force during BOP testing, and if the upward force component on wear bushing 39 during testing of the valves of tree 15 is not particularly high, locking element 67 could be eliminated.

To test the valves, the operator pumps fluid through drill pipe 72 and passage 79. Initially, pressure relief valves 83 will prevent fluid flow into chamber 77 until sufficient fluid pressure passes through seal energizing ports 76 to energize reacting member seals 75. Then, the fluid flows out pressure relief valves 83 and pressurizes chamber 77. The operator applies pressure to chamber 77 to a level that either matches the external test pressure to be applied to passages 27, 31 and 35 or creates a differential where the external test pressure is far in excess of the capabilities of wear bushing 39 and/or the annular void between the outer diameter of wear bushing 39 and tree bore 25. The pressure in chamber 77 exerts an outward force that counters the inward force caused by the test pressure to prevent collapsing of wear bushing 39. The upward force component on wear bushing 39 due to the valve test pressure is resisted by the engagement of locking element 67 with tree 15.

After completing the testing, the operator bleeds off the pressure in stem passage 79, which allows seals 75 to retract. Once retracted, the pressure within chamber 77 bleeds off below reacting member 73. The operator then retrieves tool 63 and commences drilling through the riser, BOP 62 and wear bushing 39 in a conventional manner. After the drilling has been completed, the operator runs casing and a casing hanger through riser and BOP 62 and the wear bushing 39.

The operator would then complete the well by retrieving wear bushing 39 and installing a tubing hanger with a string of tubing, the tubing hanger landing on a shoulder in tree bore 25 above production passage 27.

Although shown as part of a BOP isolation test tool, tool 63 could alternatively be used as a running tool for tree 15. In that instance, supporting member 65 would be interchanged with connector 49 of FIG. 1 and a seal similar to seal 69 (FIG. 2) added.

Figure 3:
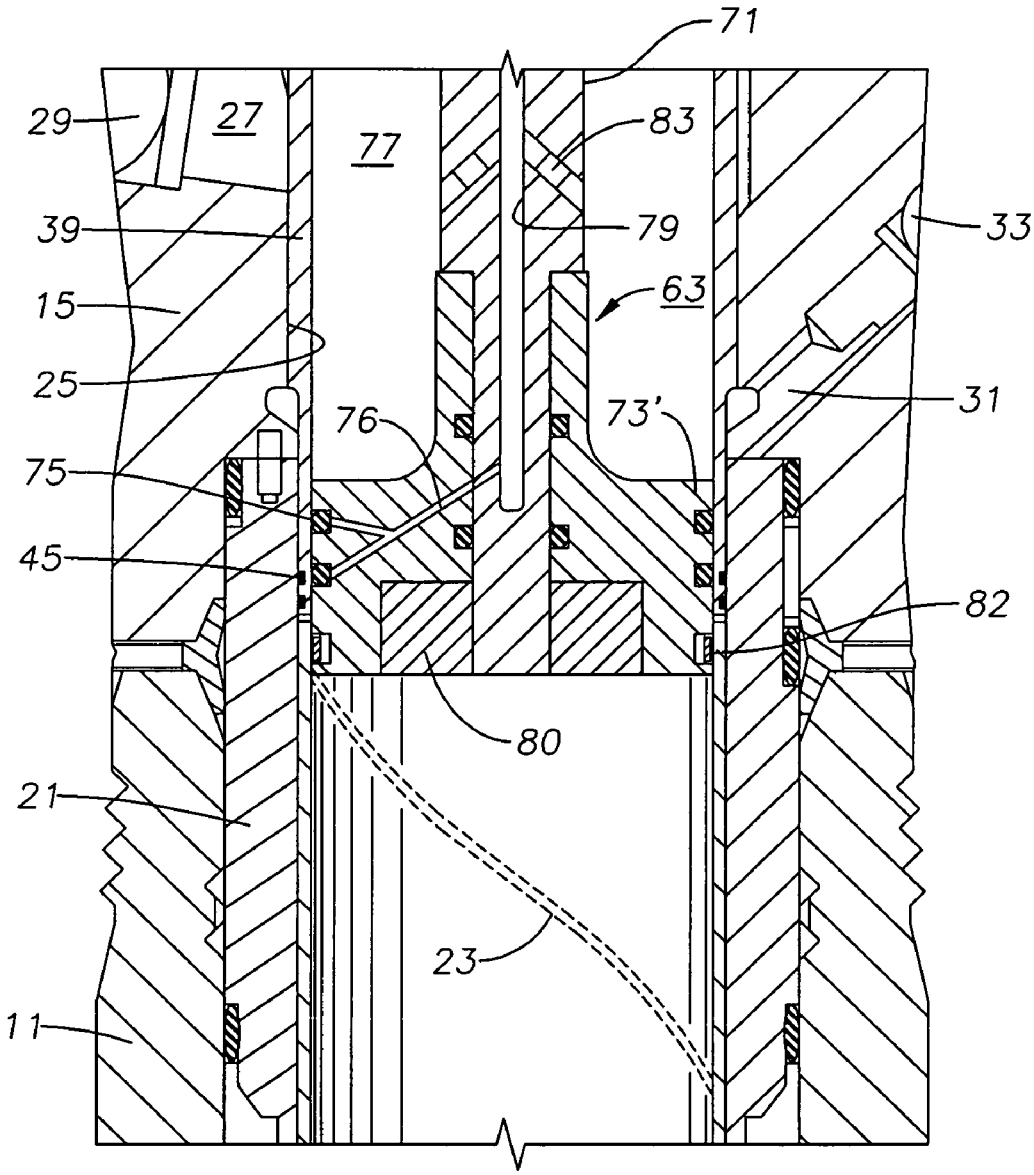
FIG. 3 is an enlarged sectional view of an alternate embodiment for a lower portion of the tool of FIG. 2.

FIG. 3 illustrates an alternate embodiment for the lower portion of tool 63 when tool 63 is part of a BOP isolation test tool. The same numerals are employed, except for the component modified, which is designated by a prime symbol. Reacting member 73' is shown as a removable component from stem 71. A nut 80 secures reacting member 73' to stem 71 by threaded engagement. In FIG. 3, reacting member 73' has a gripping member 82 that grips the inner diameter of wear bushing 39. Gripping member 82 may be a variety of types, but is shown as an outward biased split ring. Gripping member 82 is constructed to retrieve wear bushing 39 when tool 63 is retrieved.

The operator would not want to retrieve wear bushing 39 prior to drilling through tree 15, rather the retrieval occurs just before running the tubing hanger. Normally, a conventional retrieval tool is employed to retrieve wear bushing 39, but this requires an extra trip of the running string just for retrieval. By changing out reacting member 73 (FIG. 2) for reacting member 73', the operator can not only retrieve wear bushing 39, but also re-test the valves of tree 15. Tool 63 is run through BOP 62 as previously described and landed on top of wear bushing 39 as shown in FIG. 2. At this point, the operator optionally may or may not perform a test of BOP 62. Prior to applying test pressure to the valves, the operator would apply pressure to chamber 77 in the same manner as previously described to provide a reacting force against test pressure to the various ports 27, 31 and 35 and others. After testing, the operator pulls upward on tool 63, which causes wear bushing 39 to move upward also due to the engagement of gripping member 82.

In the example shown, reacting member 73' and gripping member 82 are not used during the initial testing immediately after landing tree 15, as mentioned. Rather than provide two separate reacting members 73 and 73', a gripping member (not shown) could be employed in a manner such that it remains retracted during the initial testing and retrieval. The gripping member could be selectively energized, for example, by rotating the drill string in a reverse direction after the tree valve testing had been completed.

Figure 4:
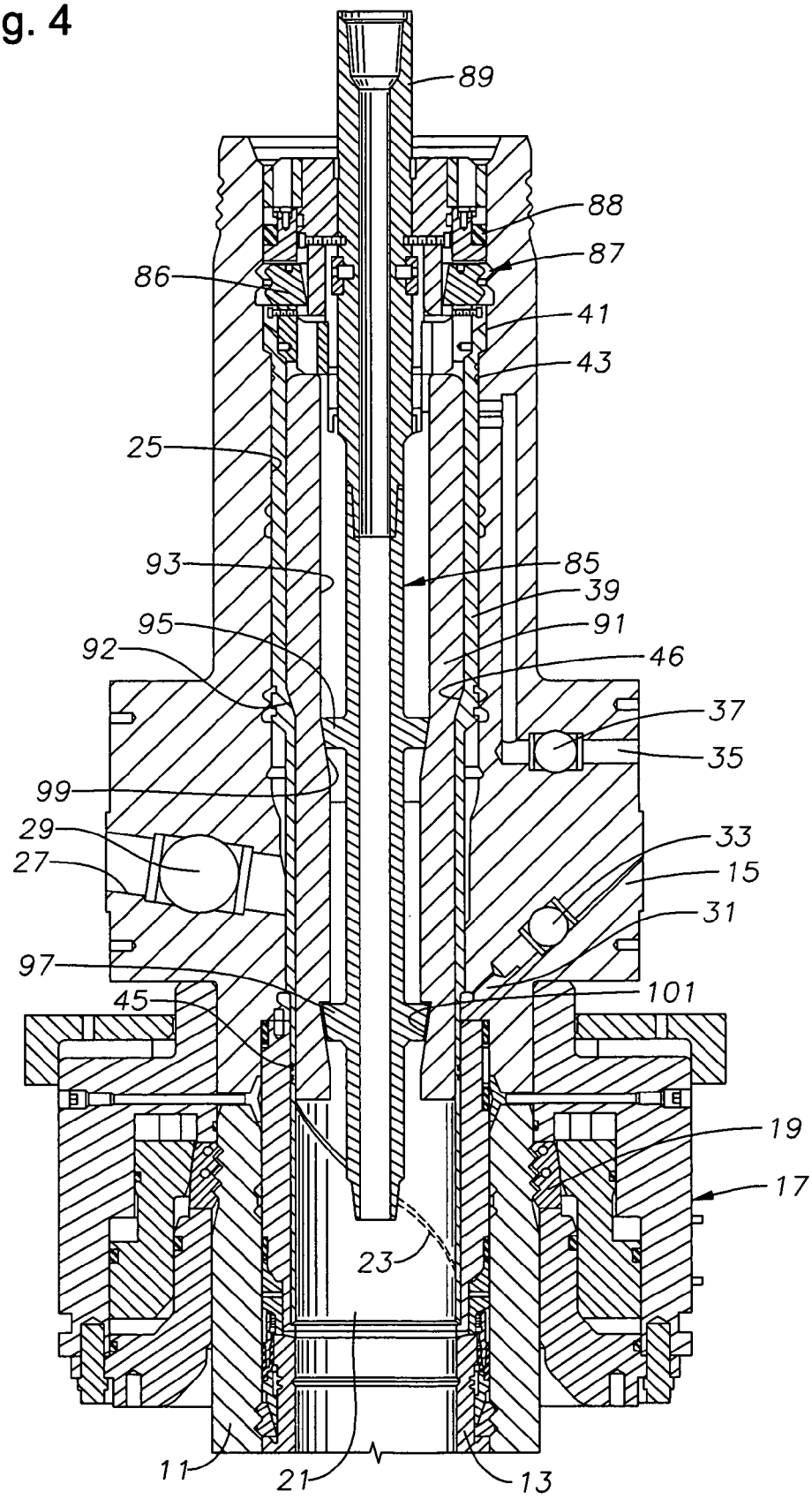
FIG. 4 is a sectional view illustrating another embodiment of a tool in accordance with this invention, the tool being a blowout preventer test tool as well as resisting test pressure forces applied externally to the wear bushing.
Figure 5:
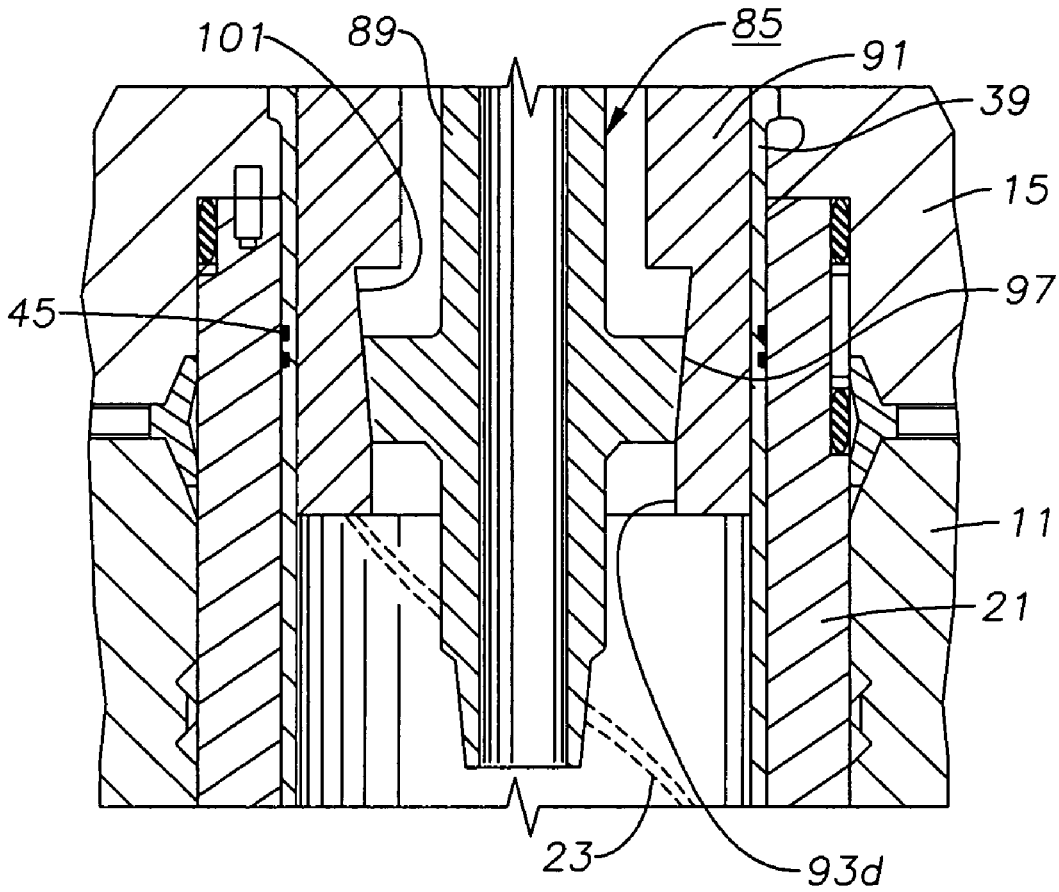
FIG. 5 is an enlarged view of a lower portion of the tool of FIG. 4.

FIGS. 4 and 5 illustrate a third embodiment. This embodiment also utilizes the same numerals for tree 15 and wear bushing 39. Tool 85 has a supporting member 87 that is constructed in the same manner as supporting member 65 of FIG. 2 and may have a locking element 86. Supporting member 87 has a seal 88 that will seal against bore 25, when energized, to serve as a blowout preventer isolation test tool. A stem 89 extends through supporting member 87.

A plurality of elongated segments 91 are carried by stem 89. Segments 91 are spaced around the circumference of stem 89 and are configured to fit closely within the inner diameter of wear bushing 39. Each segment 91 has a tapered shoulder 92 on its exterior that lands on wear bushing shoulder 46. Segments 91 define an annular member with a central bore 93 of varying inner diameter. An upper annular wedge member 95 and a lower annular wedge member 97 are rigidly connected to stem 89. In this example, the conical sidewalls of wedge members 95, 97 taper to a reduced diameter in a downward direction. Central bore 93 has an upper tapered section 99 and a lower tapered section 101 that are engaged by wedge members 95, 97 when stem 89 moves downward.

In the operation of the third embodiment, tool 85 is preferably lowered through the riser and BOP 62 (FIG. 2) and connected to tree bore 25 with supporting member 87 in the same manner as in FIG. 2. The operator rotates stem 89 to causes the J-slot (not shown) to disengage, and lowers stem 89. The downward movement energizes seal 88 and connects locking element 86 to tree 15. The downward movement also causes wedge members 95, 97 to push segments 91 radially outward. FIG. 5 shows lower wedge member 97 in a lower position, wedging segments 91 outward. The operator tests the BOP utilizing seal 88 and tests the valves of tree 15 in the same manner as in the embodiment of FIG. 2.

After the testing is completed, the operator retrieves tool 85 by lifting stem 89, causing it to move upward relative to segments 91. This removes the engagement of upper and lower wedge members 95, 97 with upper and lower tapered surfaces 99 and 101.

A gripping member similar to gripping member 82 of FIG. 3 could also be utilized with upper and lower wedge members 95, 97, if retrieval of wear bushing 39 is desired. The movement of wedge members 95, 97 between the retracted and wedged positions could be handled in a number of other ways other than by downward movement, such as by rotation of the stem. Tool 85 could alternately be part of a tree running tool, such as tool 47 of FIG. 1, rather than a BOP isolation test tool. In that instance supporting member 87 would be interchanged for connector 49 of FIG. 1.

Figure 6:
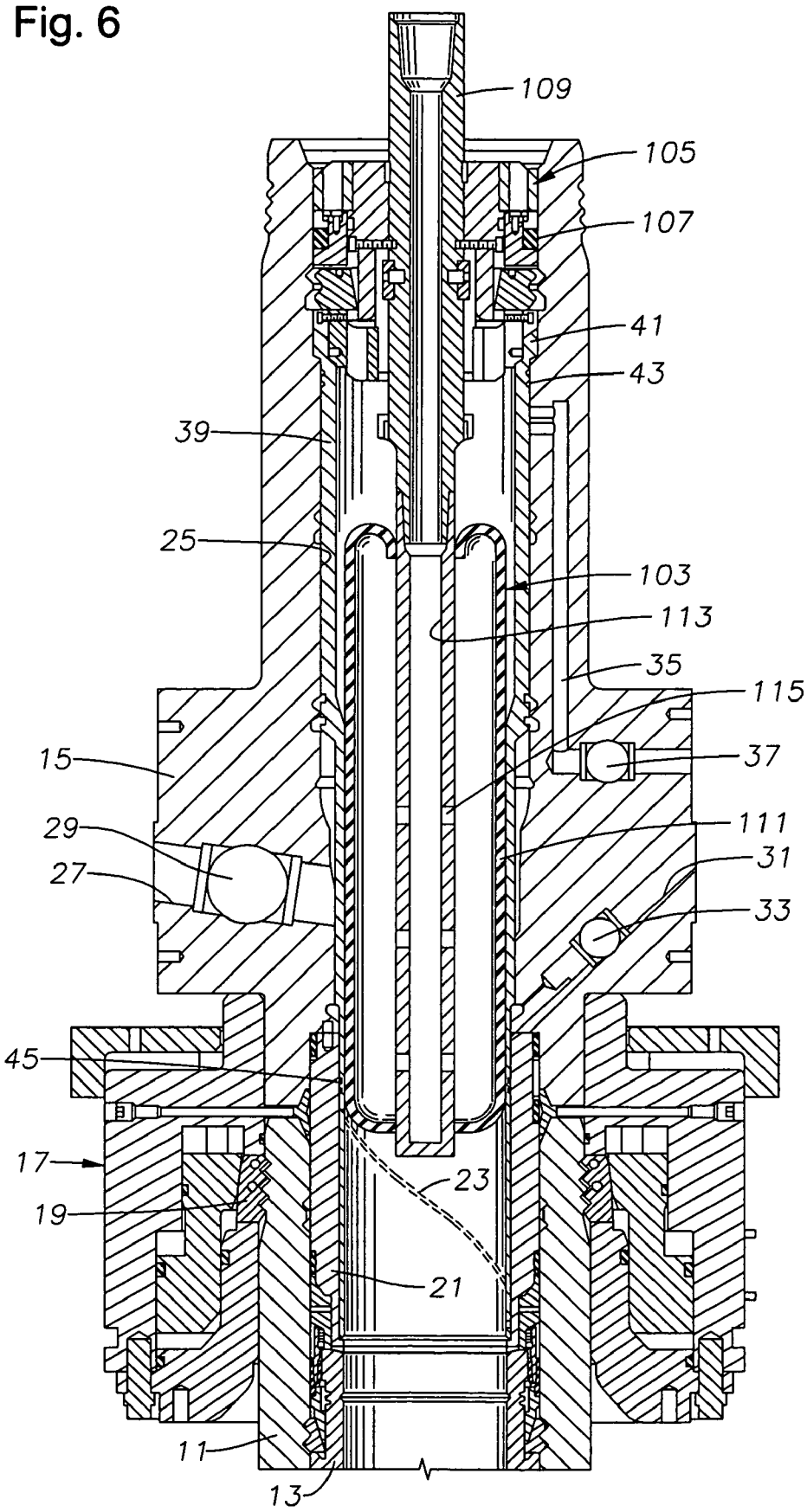
FIG. 6 is a sectional view of another embodiment of a tool constructed in accordance with this invention, the tool being a blowout preventer test tool as well as resisting test pressure forces applied externally to the wear bushing.

Referring to FIG. 6, in this embodiment, tool 103 may also be incorporated as part of a BOP isolation test tool or as part of a tree running tool. As shown, supporting member 105 has a seal 107 that seals against tree bore 25 for testing of a BOP. Stem 109 is rotated and lowered to actuate the locking element of supporting member 105. A bladder 111 is mounted to stem 109. Bladder 111 is an elastomeric annular member that has upper and lower ends sealed to stem 109. Bladder 11 can be sized to support the majority of the internal bore of wear bushing 39. A stem passage 113 extends through stem 109. Passage outlets 115 communicate the interior of bladder 111 with stem passage 113.

The operator utilizes tool 103 by pumping fluid from the surface down the drill string into stem passage 113 to inflate bladder 111. Once inflated, the operator will test valves 29, 33 and 37 in the same manner as described in connection with the other embodiments.

The invention has significant advantages. The tool allows a thin wear bushing to be used, which provides a large bore for drilling operations. The tool resists the external forces being applied to the wear bushing. Also, the tool can perform other functions to save trips. For example, the tool can be used to run the tree. The tool can alternately be used to test the blowout preventer. The tool can selectively retrieve the wear bushing during the same trip.

While the invention has been shown in a few of its forms, it should be apparent to those skilled in the art that it is not so limited but is susceptible to various changes without departing from the scope of the invention. As mentioned, rather than a tree, the tubular drill-through member could be a tubing spool, with the tree mounted on top of the tubing spool. The retrieval feature shown in FIG. 3 could be modified and incorporated with other embodiments.

We claim:

1. A method for pressure testing a subsea wellhead assembly having a tubular member with a bore and at least one port extending from the bore to the exterior of the tubular member, the method comprising:

(a) placing a wear bushing within the bore of the tubular member and providing upper and lower seals between the wear bushing and a sidewall of the bore above and below the port, the wear bushing being free of any passages extending through its sidewall at any point between the upper and lower seals, thereby defining a wear bushing annulus on an exterior of the wear bushing that is sealed from an interior of the wear bushing;

(b) providing a tool having an upper supporting member, a stem extending downward from the supporting member, and a reacting member on the stem and spaced below the supporting member, the reacting member being of larger outer diameter than an outer diameter of the stem;

(c) inserting the stem and the reacting member into the wear bushing, landing the upper supporting member in the tubular member, supporting the weight of the stem and reacting member with the supporting member, and engaging an inner diameter of the wear bushing with the reacting member; then (d) applying fluid pressure to the port, which increases fluid pressure within the wear bushing annulus and creates a differential pressure across the sidewall of the wear bushing that tends to deflect the wear bushing inward, the deflection being resisted by the reacting member.

2. The method according to claim 1, further comprising:

connecting a blowout preventer to the tubular member;

sealing the tool to the bore of the tubular member with an upper seal above the wear bushing, the upper seal defining a blowout preventer test chamber above the wear bushing that is sealed from the interior of the wear bushing; and closing the blowout preventer and applying fluid pressure to the blowout preventer test chamber between the upper seal and the blowout preventer to test the blowout preventer.

3. The method according to claim 1, wherein an upper portion of the stem extends above the upper supporting member, and the method further comprises:

securing the tool to a grooved profile formed in the bore of the tubular member above the wear bushing; and connecting the upper portion of the stem to a conduit and lowering the tubular member with the conduit from a surface platform onto a subsea wellhead housing.

4. The method according to claim 1, further comprising gripping an inner portion of the sidewall of the wear bushing with the reacting member and retrieving the wear bushing with the tool after step (d).

5. The method according to claim 1, wherein the reacting member in step (b) comprises a rigid member extending radially outward from the stem.

6. The method according to claim 1, wherein step (c) comprises:

sealing the reacting member to the inner diameter of the wear bushing with a lower seal;

sealing the tool with an upper seal to define an annular chamber within the interior of the wear bushing with an upper end of the chamber adjacent the supporting member, a lower end of the chamber at the reacting member, the chamber having an inner diameter at the stem and an outer diameter at the inner diameter of the wear bushing; and step (d) comprises:

applying fluid pressure to the chamber to exert an outward reactive force on the wear bushing to resist the deflection of the sidewall of the wear bushing.

7. The method according to claim 6, wherein step (b) comprises providing the stem with a central passage and at least one outlet passage leading through a sidewall of the stem above the reacting member and below the supporting member; and step (d) comprises:

pumping fluid into the stem and out the outlet passage into the chamber.

8. The method according to claim 1, wherein step (c) comprises radially expanding the entire portion of the reacting member that engages the wear bushing after it has been inserted into the wear bushing.

9. The method according to claim 1, wherein step (b) comprises:

providing a plurality of radially movable rigid segments that are arranged in a circumferential array around the stem to define the reacting member; and step (c) comprises wedging the segments radially outward after the stem and the reacting member have been inserted into the wear bushing.

10. The method according to claim 1, wherein step (b) comprises:

mounting an elastomeric bladder to and surrounding the stem to define the reacting member; and step (c) comprises pumping fluid through the stem to the bladder to inflate the bladder, causing the bladder to engage the inner diameter of the wear bushing.

11. A method for pressure testing a subsea wellhead assembly having a tubular member with a bore and at least one port extending from the bore to the exterior of the tubular member, the method comprising:

(a) placing a wear bushing within the bore of the tubular member and providing upper and lower seals between the wear bushing and a sidewall of the bore above and below the port, the wear bushing being free of any passages extending through its sidewall at any point between the upper and lower seals, thereby defining a wear bushing annulus on an exterior of the wear bushing that is sealed from an interior of the wear bushing;

(b) providing a tool having upper and lower packer members, each having a seal, the upper and lower packer members being connected to each other by a stem, inserting the tool into the tubular member, and with the seals, creating a sealed chamber within the wear bushing surrounding the stem and between the upper and lower packer members, the sealed chamber having a lower end below the port and an upper end above the port and below an upper end of the tubular member;

(c) applying fluid pressure to the port, which increases fluid pressure in the wear bushing annulus and creates an inwardly directed force against the sidewall of the wear bushing; and (d) applying fluid pressure through the tool to the sealed chamber to exert an outwardly directed force against the sidewall of the wear bushing to resist inward deflection of the wear bushing due to the inward directed force.

12. The method according to claim 11, further comprising:

connecting a blowout preventer to the tubular member; and closing the blowout preventer and applying fluid pressure between the upper packer member and the blowout preventer to test the blowout preventer.

13. An apparatus for pressure testing a subsea wellhead assembly having a tubular member with a bore and at least one port extending from the bore to the exterior of the tubular member, comprising:

a wear bushing located within the bore of the tubular member and sealing communication between the port and the bore, the wear bushing having exterior upper and lower seals between the wear bushing and a sidewall of the bore above and below the port, the wear bushing being free of any passages extending through its sidewall at any point between the exterior upper and lower seals, thereby defining a wear bushing annulus on an exterior of the wear bushing that is sealed from an interior of the wear bushing;

a supporting member for landing in the tubular member;

a stem extending downward from the supporting member; and a reacting member along the stem and spaced below the supporting member, the reacting member having an engaging portion for engagement with an inner diameter of the wear bushing to resist inward deflection of the wear bushing when test fluid pressure is applied to the port, which increases fluid pressure in the wear bushing annulus, the reacting member and the supporting member being of larger outer diameter than the stem.

14. The apparatus according to claim 13, wherein:

the stem has an upper end above the supporting member.

15. The apparatus according to claim 13, wherein the reacting member comprises:

a rigid member extending radially outward from the stem and defining an outer diameter substantially the same as the inner diameter of the wear bushing, the rigid member having a length that is less than a length of the stem, measured along an axis of the stem.

16. The apparatus according to claim 13, further comprising a blowout prevent test seal on the tool above the supporting member for sealingly engaging an inner diameter of the tubular member, the supporting member and the blowout preventer test seal blocking communication in the tubular member above the wear bushing with the interior of the wear bushing to enable testing of a blowout preventer.

17. The apparatus according to claim 13, wherein:

the tool has interior upper and lower seals for defining a sealed chamber in the interior of the wear bushing between the interior upper and lower seals and surrounding the stem; and the stem has a central passage and an outlet from the central passage between the interior upper and lower seals for applying fluid pressure to the sealed chamber.

18. The apparatus according to claim 13, wherein the entire engaging portion of the reacting member is radially expansible.

19. The apparatus according to claim 13, wherein the reacting member comprises:

a plurality of radially movable segments that are arranged in a circumferential array around the stem; and at least one wedge member mounted to the stem for wedging the segments radially outward in response to axial movement of the stem.

20. The apparatus according to claim 13, wherein the reacting member comprises:

an elastomeric bladder mounted to and surrounding a portion of the stem, the stem having a central passage leading to an interior of the bladder for pumping fluid through the stem to the bladder to inflate the bladder against the inner diameter of the wear bushing.

21. The apparatus according to claim 13, further comprising a gripping member on the reacting member for gripping an inner diameter portion of the wear bushing to retrieve the wear bushing.

* * * * *

UNITED STATES PATENT AND TRADEMARK OFFICE

CERTIFICATE OF CORRECTION

PATENT NO. : 7,647,973 B2
APPLICATION NO. : 11/488747
DATED : January 19, 2010
INVENTOR(S) : Minassian et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 516 days.

Signed and Sealed this

Sixteenth Day of November, 2010

David J. Kappos

David J. Kappos
*Director of the United States Patent and Trademark Office*